US006464785B1

(12) United States Patent
Puffe

(10) Patent No.: US 6,464,785 B1
(45) Date of Patent: Oct. 15, 2002

(54) ROTARY APPLICATOR HEAD

(76) Inventor: Wolfgang Puffe, Siegdamm 40, D-53721 Siegburg (DE)

( * ) Notice: Subject to any disclaimer, the term of this patent is extended or adjusted under 35 U.S.C. 154(b) by 0 days.

(21) Appl. No.: 09/582,421

(22) PCT Filed: Dec. 16, 1998

(86) PCT No.: PCT/EP98/08246

§ 371 (c)(1),
(2), (4) Date: Aug. 16, 2000

(87) PCT Pub. No.: WO99/32233

PCT Pub. Date: Jul. 1, 1999

(30) Foreign Application Priority Data

Dec. 22, 1997 (DE) ..... 197 57 237
Dec. 22, 1997 (DE) ..... 197 57 238

(51) Int. Cl.[7] ..... B05B 15/04; B05C 5/00
(52) U.S. Cl. ..... 118/301; 118/325; 118/416
(58) Field of Search ..... 118/301, 325, 118/406, 410, 413, 419, 420, 416, DIG. 4; 239/568; 156/578; 427/424; 162/139

(56) References Cited

U.S. PATENT DOCUMENTS 4,844,002 A * 7/1989 Yasui et al. ..... 118/259
4,968,534 A * 11/1990 Bogardy ..... 118/406
5,360,516 A * 11/1994 Cutright et al. ..... 118/301

FOREIGN PATENT DOCUMENTS

| | | |
|---|---|---|
| CH | 521175 | 5/1972 |
| DE | 1131079 | 6/1962 |
| DE | 2037740 | 2/1972 |
| EP | 0286755 | 10/1988 |
| EP | 0398034 | 11/1990 |
| EP | 0401614 | 12/1990 |
| EP | 0598559 | 5/1994 |
| FR | 2607728 | 6/1988 |

* cited by examiner

*Primary Examiner*—Richard Crispino
*Assistant Examiner*—Yewebdar T Tadesse
(74) *Attorney, Agent, or Firm*—Harness, Dickey & Pierce, P.L.C.

(57) ABSTRACT

An application head (11) for contract-free application of hot-melt adhesive onto a width of material (22) has a housing (12) with a control slide chamber (20). A cylinder control slide (13) is supported and is rotatably drivable in the housing. At least one supply aperture introduces an adhesive into the control slide chamber (20). A slotted nozzle (18) releases the adhesive. The slotted nozzle is controllable by the cylinder control slide (13). The nozzle extends transversely to the direction of movement of the width of material (22). The cylinder control slide (13) has a cylindrical surface which is able to seal the slotted nozzle (18) from the inside. The control slide (13) also has surface grooves (17) in the cylindrical surface. The grooves, as a function of their rotational positions, are able to communicate with the slotted nozzle. Furthermore, the cylinder control slide (13) inside the control slide chamber, has either an inner cavity (29) supplied with medium through a supply aperture, as well as radial exit bores (28) leading from the inner cavity into the surface grooves, or it has a helical or spiral-shaped surface groove in the cylindrical surface, as well as a storage volume for medium, which communicates with the at least one surface groove.

18 Claims, 6 Drawing Sheets

11
12
13
14
15
16
17
18
19
20
21
22
23
24
27
28
29

48
47b
47a 33
35
36

48

35
47
48
49
31
32
33
34
35
36
37
38
35
42
44
43

51
52
53
54
55
56
57
58
59
62
63
64
65
66
67
67a
67b
68
69

71
72
73
74
75
76
77
78
79
82
83
84
87
88
89

113
5C
5C
118
118
118
118
114
111
112
119
113
114
115
120
118
113
119
112
116
117
115

131
132
133
134
135
136
137
138
140
141
142
143

ROTARY APPLICATOR HEAD

BACKGROUND OF THE INVENTION

The invention relates to an application head for contract free application of liquid media, such as thermoplastic plastics or melted hot-melt adhesives, to a width of material which is movable relative to the application head. The application head has a housing with a control slide chamber in the housing. The control slide chamber supports a cylinder control slide which is rotatingly drivable in the housing. At least one supply aperture introduces a medium into the control slide chamber in the housing. A slotted nozzle to release the medium is coupled with the housing. The slotted nozzle is controllable by the cylinder control slide. The slotted nozzle extends transversely to the direction of movement of the width of material.

An application head is shown in German 197 14 029.7. Here, a control slide is in an axial region containing the supply aperture. The control slide is provided with a recess which extends over the entire circumference. At least in the axial region, it is not possible to arrange an exit nozzle aperture which is controlled by the control slide. This means that, in the axial region, the exit nozzle apertures have to observe an undesirably large distance. In addition, the control slide is relatively short. If the control slide had a greater length, it would be necessary to provide a plurality of supply apertures. Thus, the above-referenced problem would occur several times along the slotted nozzle.

U.S. Pat. No. 5,145,689 illustrates applying adhesive from slotted nozzles where air is directed toward the medium which leads to swirling of the emerging adhesive threads. This prevents adhesive threads from tearing off and also prevents the formation of drops which could lead to a non-uniform application of adhesive. Due to the supply air, the application heads become complicated and expensive.

Application heads of the above-mentioned type find frequent application where widths of material have to be laminated onto a substrate. To minimize the specific consumption of liquid medium and, at the same time, to ensure as uniform a distribution of the medium as possible, the medium is applied intermittently to achieve a grid-like application pattern. In order to enable, at the same time, a high transport speed of the width of material, the medium has to be applied in the direction of movement of the width of material at a high frequency. The grid points extend transversely to the direction of movement of the width of material and are arranged as closely as possible to one another.

EP 0 474155 A2 and EP 0 367985 A2 illustrate application heads where hole type nozzles are controlled by a pneumatically operated nozzle needle. The medium cannot be applied economically to the width of material when it moves at a high speed. This is due to limited maximum cycle frequency of the nozzle units. This limitation is the result of the mass inertia of the nozzle needles and of the control elements.

SUMMARY OF THE INVENTION

It is therefore an object of the present invention to provide an application head of the above-mentioned type which, even if it has a great length, it is able to achieve an extremely dense application pattern.

The objective is achieved by a cylinder control slide with the following characteristics. The cylinder control slide has an inner cavity which can be supplied with medium through a supply aperture; a cylindrical surface which can seal the slotted nozzle from the inside; surface grooves in the cylindrical surface which, as a function of their rotational positions, are able to communicate with the slotted nozzle; and radial exit bores extending from the inner cavity into the surface grooves.

The inventive application head is advantageous because medium control takes place directly at the slotted nozzle. Thus, the dispensing accuracy cannot be adversely affected by the toughness of the medium or the elasticity of the medium behind the control region. By supplying the slotted nozzle with medium from the inside of the cylinder control slide, exit apertures are arranged across the entire length of the cylinder control slide. The exit apertures are at the shortest possible distance without the possibility of any interference. By selecting different shapes of the surface grooves, it is possible to produce different grids and patterns when applying the medium.

According to a first embodiment, the surface grooves include a plurality of axis-parallel grooves. If a uniform point grid is to be achieved, a plurality of axis-parallel surface grooves are provided at uniform circumferential distances on the surfaces of the cylinder control slide. The distances between the grid points in the direction of movement of the width of material can be influenced by changing the rotational speed of the cylinder control slide. If the surface grooves are circumferentially distributed at non-uniform distances, a non-uniform point grid can be produced at a constant driving speed. If the axis-parallel surface grooves are arranged at uniform circumferential distances, a non-uniform point grid can be achieved by changing the driving speeds of the cylinder control slide. State of the art servomotors are capable of operating at non-uniform driving speeds.

Grid points which extend transversely to the direction of movement of the width of material can be achieved by using a suitable nozzle orifice plate in the slotted nozzle. The individual bores are spaced at short distances. If such a nozzle orifice plate is not used, the use of axis-parallel grooves leads to a linear application transversely to the direction of movement of the width of material.

According to a second embodiment, the surface grooves include at least one helical or spiral-shaped groove. Accordingly, open regions occur at the slotted nozzle. The open regions move along the slotted nozzle during driving of the cylinder control slide in one rotational direction. Thus, if the width of material moves at the same time, application patterns occur which extend diagonally across the width of material. In this embodiment, it is preferable to use slotted nozzles without nozzle orifice plates. Thus, the diagonal applications are applied to the width of material in the form of threads. In such a case, it is advantageous to use two application heads arranged one behind the other. The heads have oppositely directed surface groove pitches with identical rotational directions of movement or opposed rotational directions of movement and identical pitches. Thus, the heads make it possible to produce a pattern of diagonal symmetric threads of medium intersecting one another on the width of material.

In one embodiment, the cylinder control slide includes at least one journal which axially projects from the housing. An axial bore is formed in the housing and is connected to the inner cavity serving as a supply aperture. This measure makes the housing design particularly simple. However, a rotating seal is provided in the region of the medium supply means subjected to pressure. According to an alternative embodiment, at at least one end of the housing, a bore is provided in the housing. Also, an annular channel is between the cylinder control slide and the control slide chamber. The annular channel is connected to the bore in the housing. Radial supply bores are provided in the cylinder control slide in the plane of the annular channel. The bores are connected to the inner cavity and serve as supply apertures. As a result of this measure, it is possible to simplify the control slide bearing. The medium can be supplied to the housing via simple radial bores. The annular channel can be formed by an annular groove in the cylinder control slide surface and/or by a circumferential groove in the control slide chamber bore. The annular channel can also be arranged in the region of the end faces of a cylinder control slide being reduced at the journals. Here, the radial supply bores are replaced by axial supply bores in the end faces. Independently of whether supply means are provided at only one end or at both ends of the cylinder control slide, it is possible to compensate for a slight pressure loss in the medium along the length of the control slide by slightly increasing the diameter of the radial exit bores leading to the grooves. The medium is prevented from escaping from the housing by using conventional shaft seals.

Furthermore, the objective is achieved by the cylinder control slide having the following characteristics. The cylinder control slide has a cylindrical surface which can seal the slotted nozzle from the inside; at least one helical or spiral-shaped surface groove in the cylindrical surface which, as a function of its rotational position, in certain portions, is able to communicate with the slotted nozzle; and a storage volume for medium inside the control slide chamber, which storage volume communicates with at least one surface groove.

At the points of intersection between the slotted nozzle and the convolution of the spiral-shaped surface groove, the inventive application head generates exit apertures which move in one direction along the nozzle slot when the cylinder control slide rotates. As a result, when the drive of the cylinder control slide rotates and when the width of material is simultaneously driven in the direction of movement, an infinite number of parallel threads are produced which extend diagonally to the direction of movement in the width of material. In consequence, the medium is applied continuously in the longitudinal direction of the width of material. The thread thickness can be kept very small. A very close application pattern is achieved with a slight pitch of the spiral-shaped surface groove and a plurality of convolutions. In an advantageous embodiment, two application heads are provided which are arranged one behind the other. The cylinder control slides of the application heads are driven in identical rotational directions and have oppositely directed surface groove pitches or, if the surface grooves have identical pitches, include oppositely directed driving rotational directions of the cylinder control slides. If both application heads are actuated and supplied with medium at the same time, a web of intersecting diagonal threads is formed on the width of material.

According to a first embodiment, the control slide chamber, in at least one circumferential region, is widened relative to the cross-section of the cylinder control slide. The widened cavity between the wall of the control slide chamber and the surface of the cylinder control slide forms the storage volume. This embodiment has both a simple housing shape and a simple shape of the solidly produced cylinder control slide. The distances between the individual exit apertures and the storage volume are extremely short and are formed by the individual contours of the surface groove.

According to a second embodiment, the cylinder control slide includes an inner cavity. The inner cavity forms the storage volume. The control slide chamber surrounds the cylinder control slide substantially sealingly with a cylindrical surface. The radial bores lead from the inner cavity into the surface groove. The variant described here is advantageous in that the surface groove is radially supplied with medium over an extremely short distance. The transport of material in the longitudinal direction of the surface groove is completely eliminated. Precision control of the exit apertures is increased. To compensate for any pressure losses along the length of the inner cavity, the size of the radial bores can increase with the distance from the supply point.

In the former embodiment, a housing bore can be connected to the inside of the control slide chamber. The housing bore forms the supply aperture.

According to a second embodiment, the cylinder control slide includes at least one journal which projects from the housing. The journal has an axial bore which forms the supply aperture leading into the inside of the cylinder control slide.

According to an alternative to the second embodiment, at least one housing bore is connected to an annular channel between the control slide chamber and the cylinder control slide. The radial bores start from the annular channel and lead into the inside of the cylinder control slide to form the at least one supply aperture. In this way, the inside of the cylinder control slide is supplied first with medium, via the annular channel. From the inside of the cylinder control slide, the medium again enters the surface groove via the radial bores.

From the following detailed description, taken in conjunction with the drawings and subjoined claims, other objects and advantages of the present invention will become apparent to those skilled in the art.

BRIEF DESCRIPTION OF THE DRAWINGS

Preferred embodiments of the invention will be explained below with reference to the drawings wherein.

DETAILED DESCRIPTION OF THE PREFERRED EMBODIMENT

FIGS. 1*a*–4*a* illustrate a perspective view of an application head with a width of material with an application pattern. Above this is FIGS. 1*b*–4*b*, a detail of a cylinder control slide in a perspective view. Above this is FIGS. 1*c*–4*c* which is the housing with a cylinder control slide and, respectively, the cylinder control slide on its own in cross-section. The perspective illustration of the cylinder control slide in the form of a detail is associated with the two enlarged surface regions (FIGS. 1*d,e*–4*d,e*).

Figures 1A, 1B, 1C, 1D, 1E:
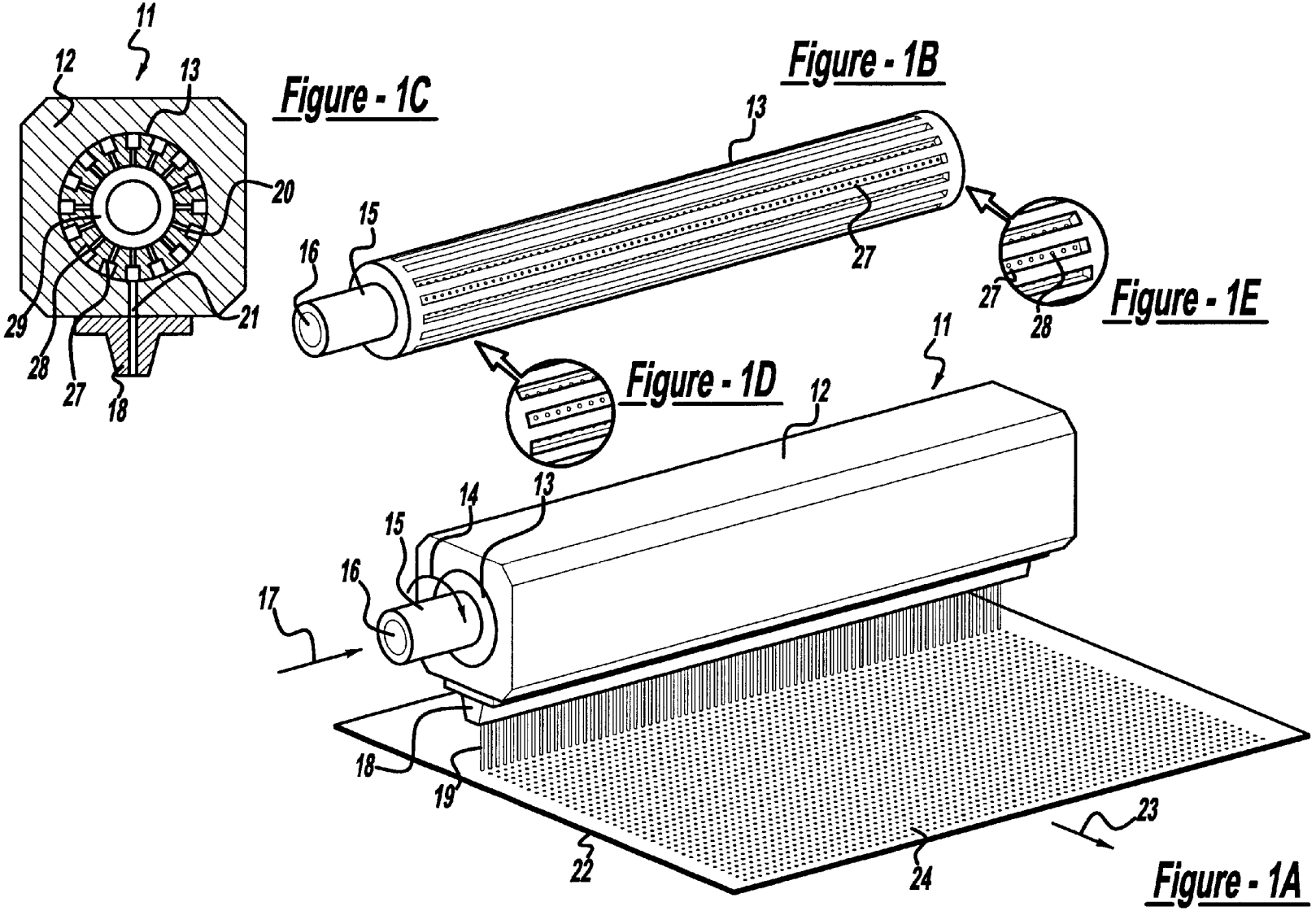
FIGS. 1(*a–e*) are perspective and partially in section views of an application head with axis-parallel identically designed surface grooves in the cylinder control slide, with the medium supplied through a slide journal.

FIG. 1*a* shows an application head 11 with an oblong, cubic shape. One end of a cylinder control slide 13 projects from the housing 12 of the application head 11. The direction of rotation of the cylinder control slide 13 is indicated by an arrow 14. The end of the cylinder control slide 13 has a journal 15 which includes an axial bore 16. Medium is supplied through the bore 16 as indicated by the arrow 17. A slotted nozzle 18 is underneath the housing 12. A spray curtain 19 emerges from the slotted nozzle 18. The spray curtain 19 hits a width of material 22 whose direction of movement is symbolized by an arrow 23. On the width of material 22, the spray curtain 19 generates an application grid 24 which constitutes a square or rectangular point grid. This demonstrates that the slotted nozzle 18 has a hole type orifice plate which determines the distance between the grid points which extend transversely to the direction of movement of the width of material 22.

As can be seen in detail in FIG. 1*b*, the cylinder control slide 13, on its cylindrical surface, includes a plurality of axial grooves 27. The grooves include radial bores 28. Furthermore, as can be seen in the cross-section FIG. 1*c*, the radial bores 28 are supplied with medium through an inner cavity 29. The cavity 29 forms a storage volume for medium. Via the radial bores 28, the axial grooves 27 are constantly filled with medium. The cylinder control slide can be driven by a servomotor via a journal which is positioned opposite the journal 15. The journal 15 can also project from the housing 12. As can be seen in the cross-section in FIG. 1*c*, the housing 12 encloses the cylinder control slide 13 via a cylindrical control slide chamber 20. Radial channels 21 lead to the slotted nozzle 18 from the control slide chamber 20. As shown by the details in FIGS. 1*d* and 1*e*, the radial bores 28 are smaller in the vicinity of the axial bore 16 than further away from the bore 16.

Figures 2A, 2B, 2C, 2D, 2E:
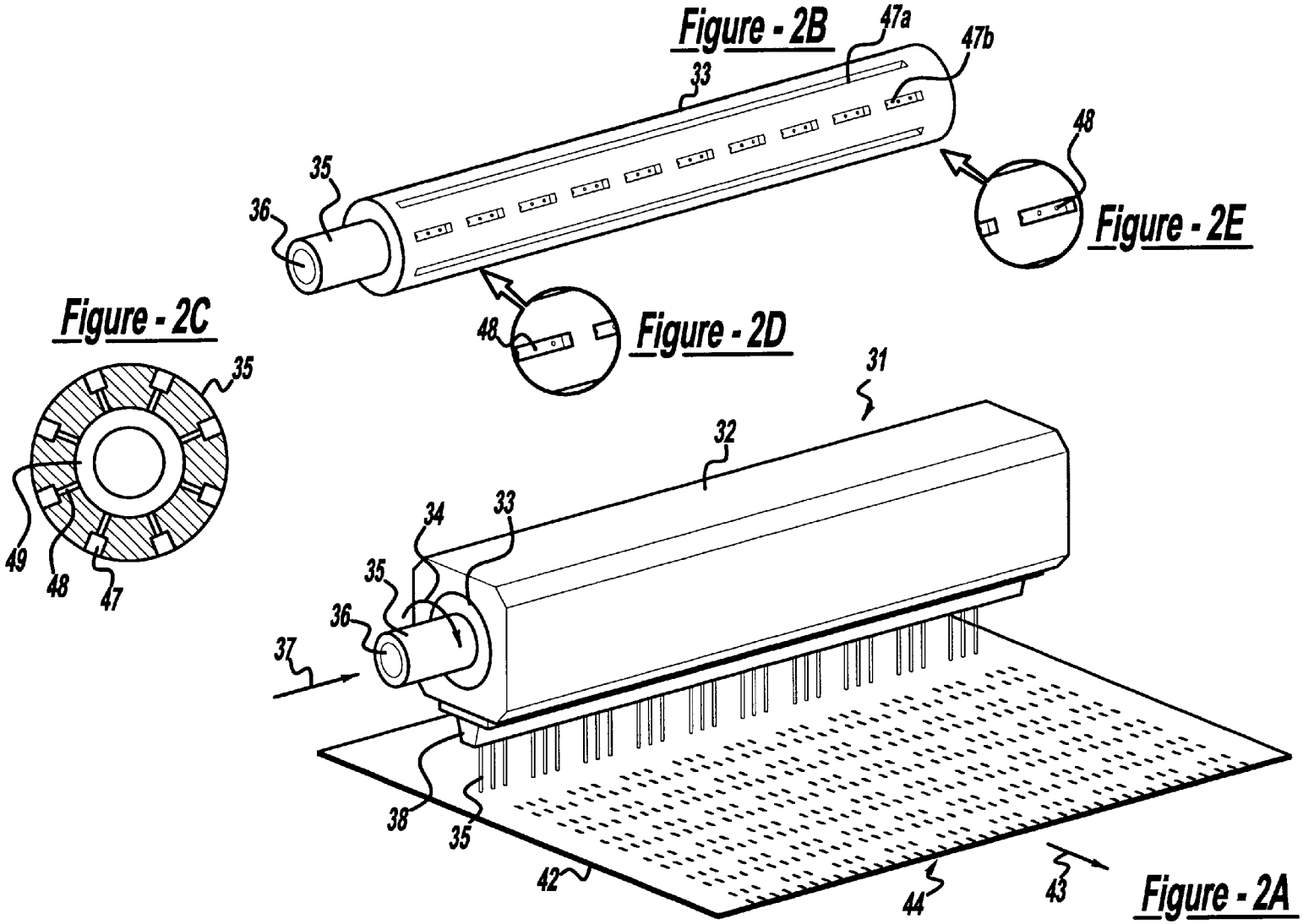
FIGS. 2(*a–e*) are perspective and partially in section views of an application head with axis-parallel surface grooves with variable lengths in the cylinder control slide, with the medium supplied through a slide journal.

FIG. 2*a* shows an application head 31 with an oblong cubic shape. One end of a cylinder control slide 33 projects from the housing 32 of the application head 31. The direction of rotation of the cylinder control slide 33 is indicated by an arrow 34. The end of the cylinder control slide 33 includes a journal 35. The journal 35 has an axial bore 36 through which medium is supplied, as indicated by the arrow 37. A slotted nozzle 38 is underneath the housing 32. A spray curtain 39 emerges from the nozzle 38. The spray curtain 39 hits the width of material 42 whose direction of movement is symbolized by an arrow 43. On the width of material 42, the spray curtain 39 generates an application grid 44. The grid 44 constitutes an alternately continuous and interrupted line grid. This demonstrates that the slotted nozzle 38 is provided with an orifice plate. The orifice plate determines the distance between the grid lines which extend transversely to the direction of movement of the width of material 42.

As can be seen in detail in FIG. 2*b*, the cylinder control slide 33, on its cylindrical surface, includes a plurality of continuous axial grooves 47*a* and interrupted axial grooves 47*b*. Groove 47*b* includes radial bores 48. The radial bores 48 are supplied with medium via the axial bore 46 and inner cavity 49. The inner cavity 49 forms a storage volume for the medium. Via the radial bores 48, the axial grooves 47 are constantly filled with medium. The cylinder control slide can be driven by a servomotor via a journal which is positioned opposite the journal 35. The second journal may also project from the housing 32. In a cross-sectional view FIG. 2*c*, the housing 32 has to be assumed to have the same shape as that shown in FIG. 1. As demonstrated by the details in FIGS. 2*d* and 2*e*, the radial bores 48 in the vicinity of the axial bore 36 are smaller than those further away.

Figures 3A, 3B, 3C, 3D, 3E:
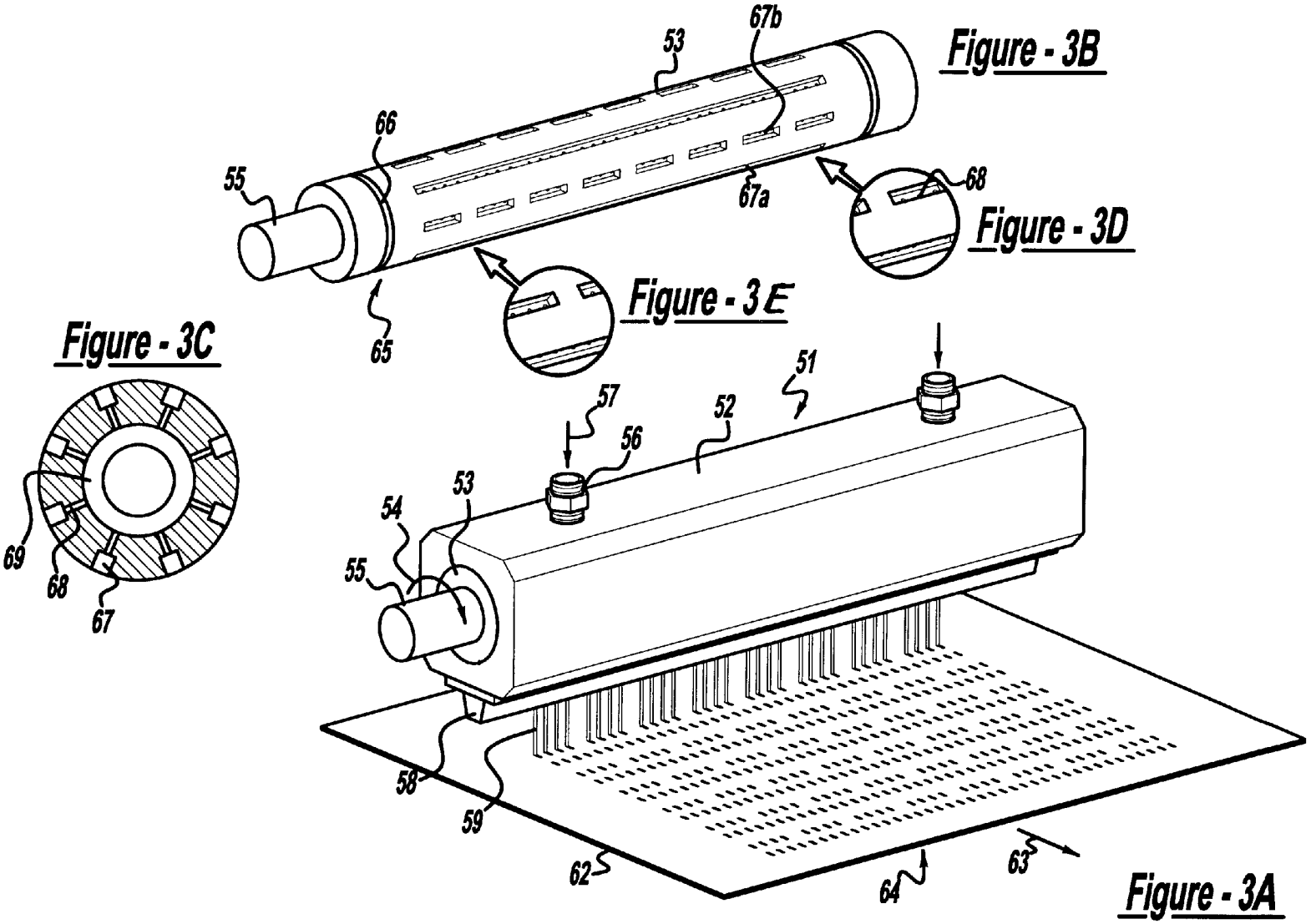
FIGS. 3(*a–e*) are perspective and partially in section views of an application head with axis-parallel surface grooves with variable lengths in the cylinder control slide, with the medium supplied through the housing.

FIG. 3*a* shows an application head 51 with an oblong cubic shape. One end of a cylinder control slide 53 projects from the housing 52 of the application head 51. The direction of rotation of the cylinder control slide 53 is indicated by an arrow 54. The housing 52 is provided with two supply muffs 56. Medium is supplied through the muffs 56 as indicated by the arrow 57. A slotted nozzle 58 is underneath the housing 52. A spray curtain 59 emerges from the nozzle 58. The spray curtain 59 hits the width of material 62 whose direction of movement is symbolized by an arrow 63. On the width of material 62, the spray curtain 59 generates an application grid 64. The grid 64 is alternately a continuous and an interrupted line pattern. This demonstrates that the slotted nozzle 58 includes an orifice plate. The orifice plate determines the distance between the grid lines which extend transversely to the direction of movement of the width of material 62.

As can be seen in detail in FIG. 3*b*, the cylinder control slide 53, on its cylindrical surface, comprises a plurality of continuous axial grooves 67*a* and interrupted axial grooves 67*b*. Groove 67*b* includes radial bores 68. The radial bores 68 are supplied with medium indirectly via the muffs 56. Muffs 46 pass medium into circumferential grooves 65. In turn, medium is passed in radial bores 66 and into an inner cavity 69. The inner cavity 69 forms a storage volume for the medium. The medium exits the cavity 69 into the bore 68. Via the radial bores 68, the axial grooves 67 are constantly filled with medium (see FIG. 3*c*). The cylinder control slide can be driven by a servomotor via a journal. The second journal is positioned opposite the journal 55 and may also project from the housing 52. In a cross-sectional view FIG. 3*c*, the housing 52 has to be assumed to have the same shape as that shown in FIG. 1.

Figures 4A, 4B, 4C, 4D, 4E:
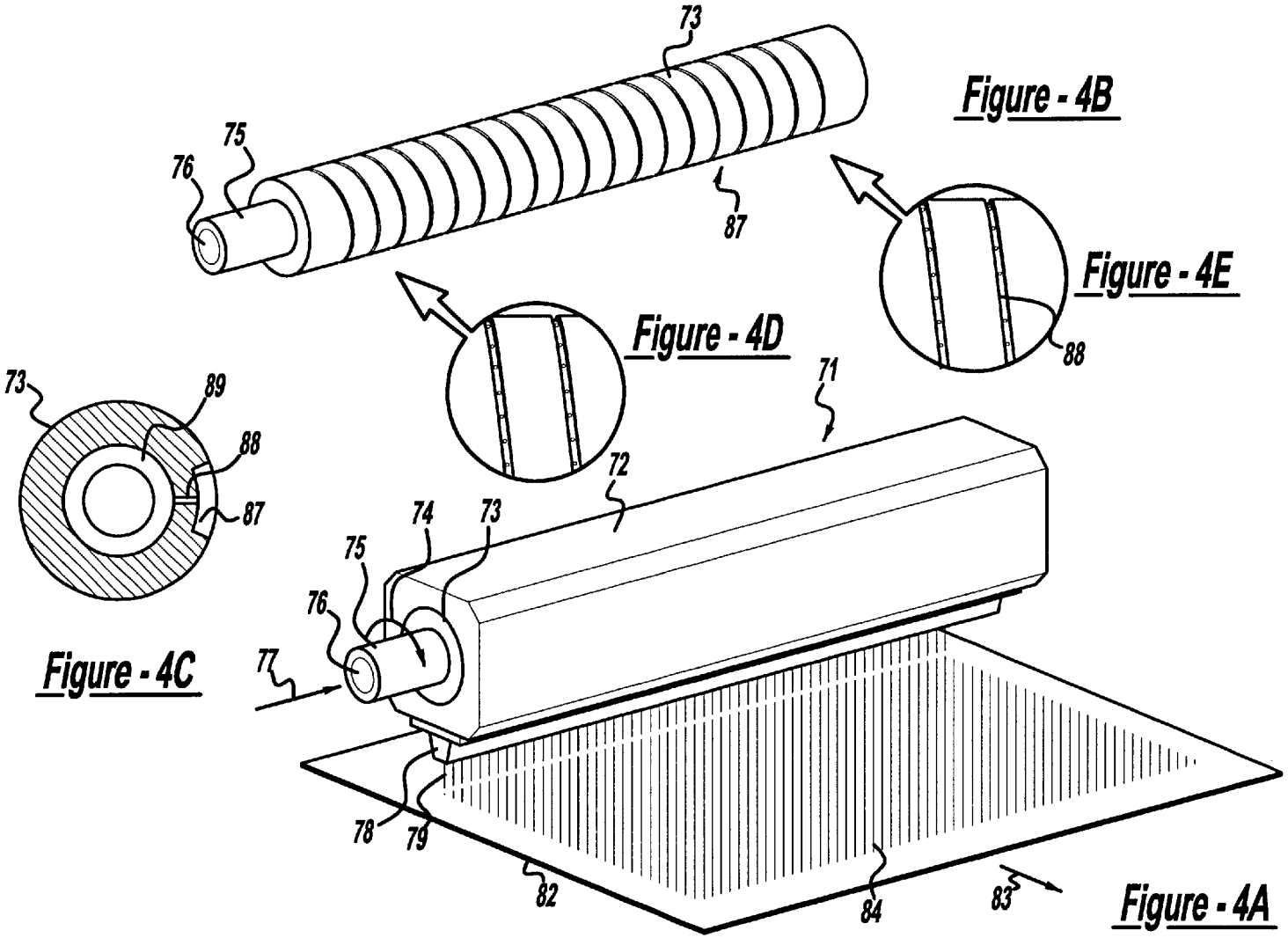
FIGS. 4(*a–e*) are perspective and partially in section views of an application head with a cylinder control slide with a spiral-shaped surface groove, with the medium supplied through a slide journal.

FIG. 4*a* illustrates an application head 71 with an oblong cubic shape. One end of a cylinder control slide 73 projects from the housing 72 of the application head 71. The direction of rotation of the cylinder control slide 73 is indicated by an arrow 74. The end of the cylinder control slide 73 is provided with a journal 75. The journal 75 includes an axial bore 76 through which medium is supplied, as indicated by the arrow 77. A slotted nozzle 78 is underneath the housing 72. A spray curtain 79 emerges from the nozzle 78. The spray curtain 79 hits the width of material 82 whose direction of movement is symbolized by an arrow 83. On the width of material 82, the spray curtain 79 generates an application grid 84. The grid 84 has a diagonal parallel line pattern. This demonstrates that the slotted nozzle 78 includes an orifice plate. The orifice plate determines the distance between the lines extending transversely to the direction of movement of the width of material 82.

As can be seen in detail in FIG. 4*b*, the cylinder control slide 73, on its cylindrical surface, is provided with a helical groove 87. The groove 87 includes radial bores 88. The radial bores 88 are supplied with medium via the axial bore 75 and the inner cavity 89. The inner cavity 89 forms a storage volume for medium. Via the radial bores 88, the helical groove 87 is constantly filled with medium. The cylinder control slide can be driven by a servomotor via a journal. The second journal is positioned opposite the journal 75 and may also project from the housing 72. In a cross-sectional view FIG. 4*c*, the housing 72 has to be assumed to have the same shape as that shown in FIG. 1.

Figures 5A, 5B, 5C, 5D, 5E:
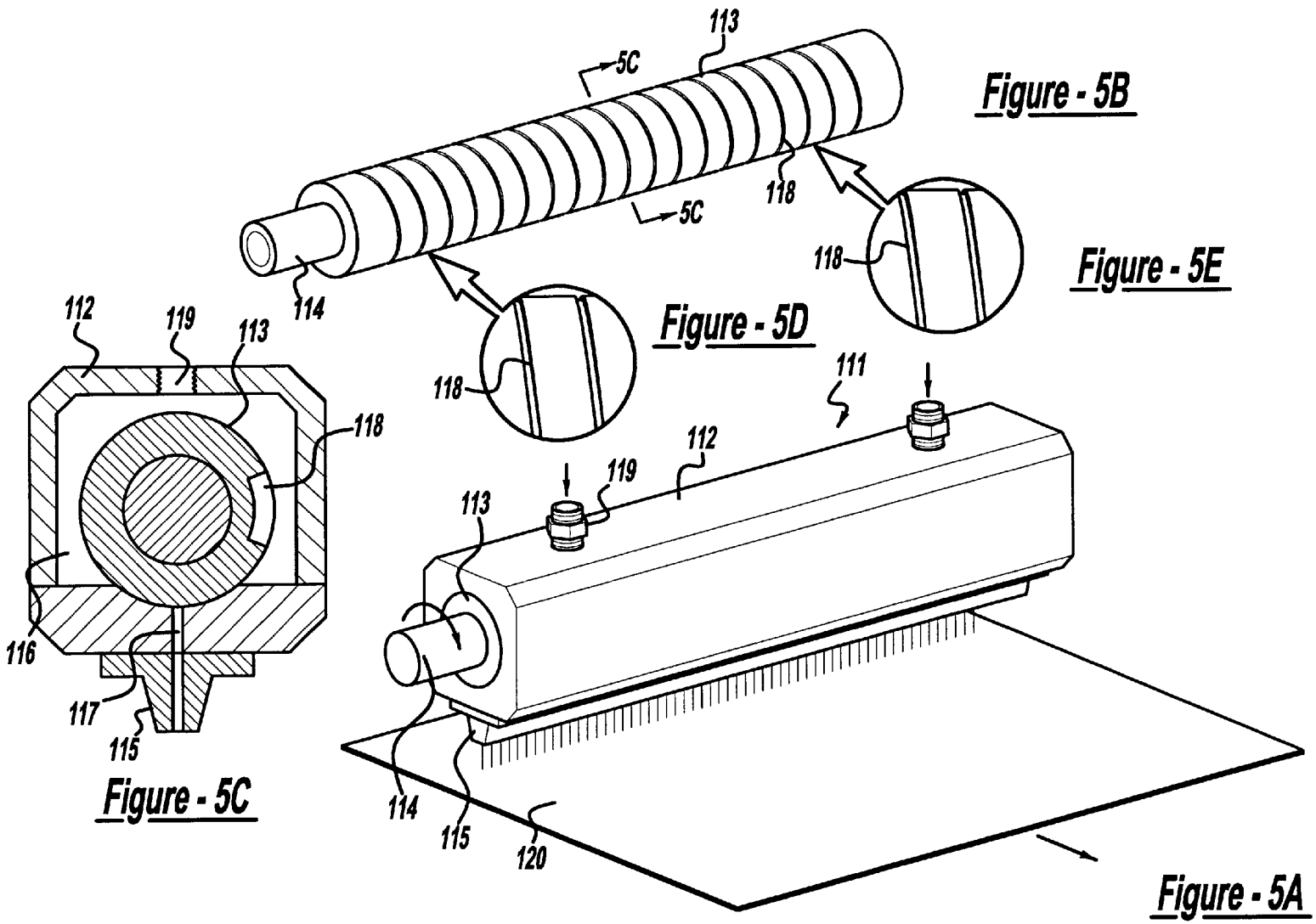
FIGS. 5(*a–e*) are perspective and partially in section views of an inventive application head, with the medium supplied through a widened cavity in the housing.
Figures 6A, 6B, 6C, 6D, 6E:
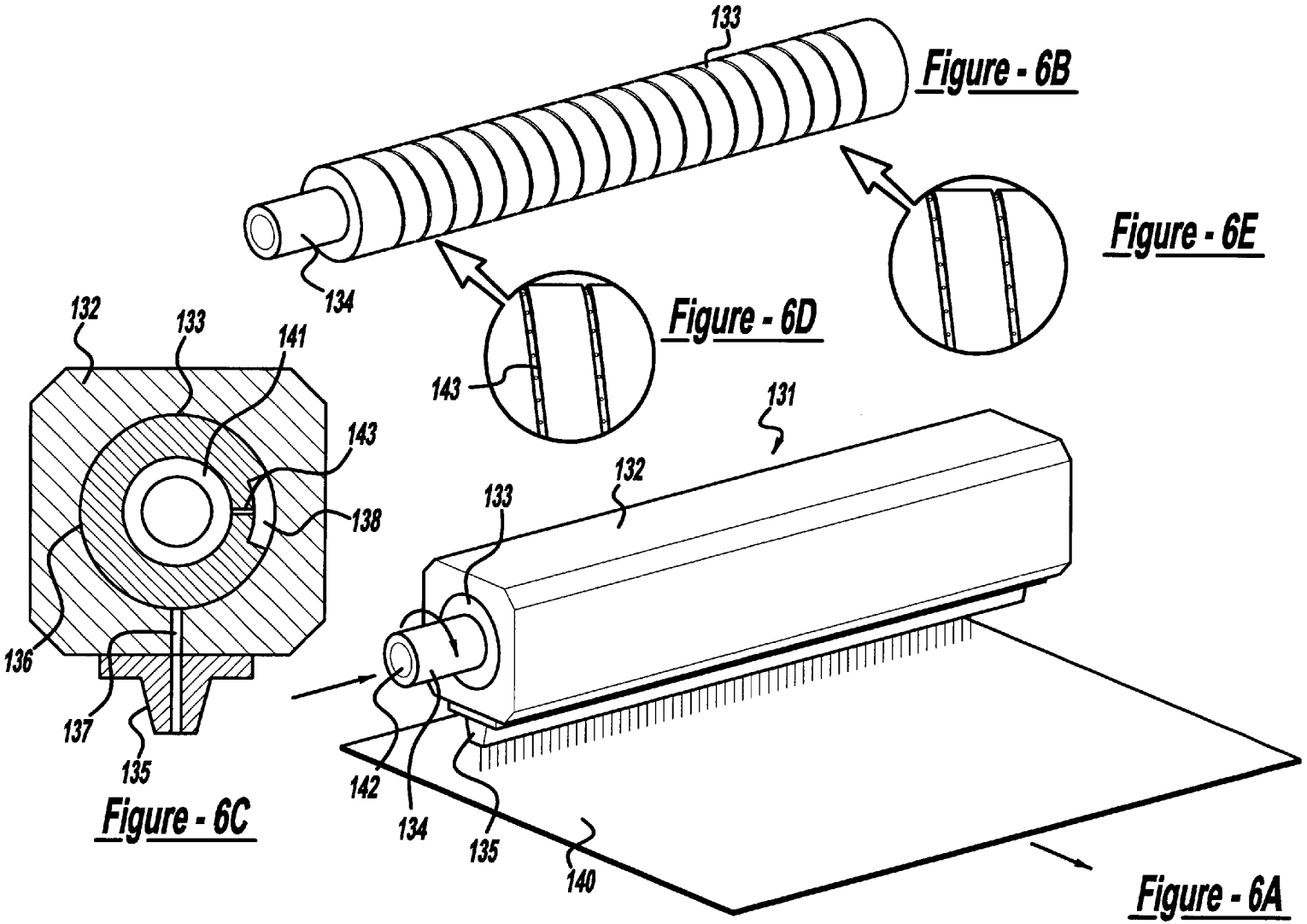
FIGS. 6(*a–e*) are perspective and partially in section views of an inventive application head, with the medium supplied to the spiral-shaped groove through the inside of the cylinder control slide.

FIGS. 5*a–e* and 6*a–e* show an application head with a width of material. A cylinder control slide in the form of a detail in a perspective view is shown at FIGS. 5*b* and 6*b*. A housing with the cylinder control slide in a cross-sectional view is shown at FIGS. 5*c* and 6*c*. The perspective illustration of the roller gate in the form of a detail is associated with FIGS. 5*d* and 6*d* and showing two enlarged surface regions (FIGS. 5*e* and 6*e*).

FIG. 5*a* shows an application head 111 with a housing 112 in which a cylinder control slide 113 rotates. Journal 114 projects from the front end of the housing 112. A slotted nozzle 115 can be seen underneath the housing 112. As can be seen in the detail in FIG. 5*b*, the cylinder control slide 113 includes a spiral-shaped surface groove 118. The cross-sectional illustration of FIG. 5*c* shows that the cylinder control slide 113, at a distance therefrom, is surrounded by a control slide chamber 116. only in the region of nozzle slot 117 is the cylinder control slide 113 in sealing contact with the surface of the control slide chamber 116. In a circumferential region, the surface groove 118 is shown in section. The control slide chamber 116 is supplied with medium through attaching muffs 119. The medium enters the surface groove directly. In the case of driving of the cylinder control slide 113 indicated by a rotary arrow, the sectional regions move between the surface groove 118 and the nozzle slot 117 from left to right along the slotted nozzle 115. From the slotted nozzle 115, a material curtain emerges of individual threads. The threads, on a width of material 120, during transport, form a group of adhesive threads extending diagonally relative to the width of material. The direction of movement of the width of material 120 is indicated by an arrow.

FIG. 6*a* shows an application head 131 with a housing 132. A cylinder control slide 133 rotates in the housing 132. Journal 134 projects from the front end of the housing 132. A slotted nozzle 135 can be seen underneath the housing 132. As can be seen in the detail in FIG. 6*b*, the cylinder control slide 133 is provided with a spiral-shaped surface groove 138. As can be seen in sectional illustration of FIG. 6*c*, the cylinder control slide 133 is sealingly enclosed by a cylindrical control slide chamber 136. The cylinder control slide 133 includes an inner cavity 141 which is supplied with medium through an axial bore 142 in the journal 134. The inner cavity 141 passes medium through a plurality of radial bores 143 into the surface groove 138. From there, the medium can emerge through a controlled nozzle slot 137. The size of the radial bores 143 increases with the distance from the medium supply through the axial bore 142 in order to compensate for any pressure decrease in the medium. In a circumferential region, the surface groove 118 is shown in section in FIGS. 6*d*, 6*e*. In the case of driving of the cylinder control slide 133 indicated by a rotary arrow, the sectional regions between the surface groove 138 and the nozzle slot 137 move from left to right along the slotted nozzle 135. From the slotted nozzle 135, a material curtain emerges of individual threads. The threads, on a width of material 140, form a group of adhesive threads which extend diagonally relative to the width of material. The direction of movement of the width of material 140 is indicated by the arrow 124.

While the above detailed description describes the preferred embodiment of the present invention, the invention is susceptible to modification, variation and alteration without deviating from the scope and fair meaning of the subjoined claims.

What is claimed is:

1. An application head for contact-free application of liquid media onto a width of material which is movable relative to the application head, said application head comprising:

a housing having a control slide chamber in said housing;

a cylinder control slide rotatably drivable and supported in said housing;

at least one supply aperture for introducing a medium into the control slide chamber;

a slotted nozzle for releasing the medium, said slotted nozzle being controllable by the cylinder control slide and extending transversely to the direction of movement of the width of material;

said cylinder control slide further comprising:

an inner cavity which can be supplied with medium through the supply aperture;

a cylindrical surface which can seal the slotted nozzle from the inside;

surface grooves in the cylindrical surface which, as a function of their rotational positions, are able to communicate with the slotted nozzle; and radial exit bores extending from the inner cavity into the surface grooves.

2. An application head according to claim 1, wherein the slotted nozzle comprises a nozzle through-slot.

3. An application head according to claim 1, wherein the slotted nozzle comprises a plurality of nozzle holes which adjoin one another and which, in particular, are formed by an orifice plate with individual grooves or individual bores.

4. An application head according to claim 1, wherein the surface grooves comprise a plurality of axis-parallel grooves.

5. An application head according to claim 1, wherein the surface grooves comprise at least one helical or spiral-shaped groove.

6. An application head according to claim 1, wherein the cylinder control slide comprises at least one journal which axially projects from the housing and in which there is provided an axial bore which is connected to the inner cavity and serves as a supply aperture.

7. An application head according to claim 1, wherein at at least one end of the housing, a bore is provided in the housing and an annular channel between the cylinder control slide and the control slide chamber, said annular channel is connected to the bore in the housing, and radial supply bores being provided in the cylinder control slide in the plane of the annular channel, said radial bores are connected to the inner cavity and serve as supply apertures.

8. An application head according to claim 7, wherein the annular channel is formed by an annular groove in the control slide chamber surface.

9. An application head according to claim 7, wherein the annular channel is formed by a circumferential groove in the cylinder control slide.

10. An application head according to claim 4, wherein a diameter of the radial exit bores leading into the axis-parallel surface grooves increases with the distance from the at least one supply aperture.

11. An application head according to claim 1, wherein the control slide chamber is cylindrical and substantially sealingly encloses the cylinder control slide.

12. An application head according to claim 7, wherein the at least one supply aperture is sealed by shaft seals relative to the cylinder control slide region provided with surface grooves.

13. An application head for contact-free application of liquid media to a width of material which is movable relative to the application head, said application head comprising:

a housing having a control slide chamber in the housing;

a cylinder control slide rotatingly drivable and supported in said housing;

at least one supply aperture for introducing a medium into the control slide chamber;

a slotted nozzle for releasing the medium, said slotted nozzle controllable by the cylinder control slide and extending transversely to the direction of movement of the width of material;

said cylinder control slide further comprising:

a cylindrical surface which can seal the slotted nozzle from the inside;

at least one helical or spiral-shaped surface groove in the cylindrical surface which, as a function of its rotational positions, is able to communicate with the slotted nozzle; and a storage volume for medium inside the control slide chamber, said storage volume communicates with the at least one surface groove.

14. An application head according to claim 13, wherein the control slide chamber, in at least one circumferential region, is widened relative to the cross-section of the cylinder control slide and the widened cavity between the wall of the control slide chamber and the surface of the cylinder control slide forms the storage volume.

15. An application head according to claim 13, wherein the cylinder control slide comprises an inner cavity which forms the storage volume and the control slide chamber substantially sealingly surrounding the cylinder control slide with a cylindrical surface, and radial bores leading from the inner cavity into the surface groove.

16. An application head according to claim 14, wherein at least one housing bore is connected to the inside of the control slide chamber which forms the supply aperture.

17. An application head according to claim 15, wherein the cylinder control slide comprises at least one journal projecting from the housing and being provided with an axial bore which forms the supply aperture leading to the inner cavity of the cylinder control slide.

18. An application head according to claim 15, wherein at least one housing bore is connected to the annular channel between the control slide chamber and the cylinder control slide and radial bores, starting from the annular channel, leading into the inside of the cylinder control slide and forming the at least one supply aperture leading to the inner cavity of the cylinder control slide.

* * * * *